US007735162B2

(12) United States Patent
Ringholz

(10) Patent No.: US 7,735,162 B2
(45) Date of Patent: Jun. 15, 2010

(54) TOILET SYSTEM TO ACCOMMODATE USERS WITH IMPAIRED MOBILITY

(76) Inventor: James P. Ringholz, 6635 W. Bancroft St., #145S, Toledo, OH (US) 43615

( * ) Notice: Subject to any disclaimer, the term of this patent is extended or adjusted under 35 U.S.C. 154(b) by 307 days.

(21) Appl. No.: 11/593,320

(22) Filed: Nov. 6, 2006

(65) Prior Publication Data

US 2007/0131835 A1 Jun. 14, 2007

Related U.S. Application Data

(60) Provisional application No. 60/733,726, filed on Nov. 4, 2005.

(51) Int. Cl.
*A47K 11/06* (2006.01)

(52) U.S. Cl. ..... 4/480; 4/571.1; 4/562.1; 108/59; 108/102; 248/424

(58) Field of Classification Search ..... 248/424, 248/429, 430, 346.01; 108/59, 102; 4/571, 4/562.1, 480, 571.1, 476, 460, 449, 560.1; 297/188.09, 423.17, 423.33; 141/98, 661, 141/231

See application file for complete search history.

(56) References Cited

U.S. PATENT DOCUMENTS 3,271,785 A * 9/1966 Du Bose ..... 4/480
4,161,793 A 7/1979 Merchan
4,266,305 A * 5/1981 Kavaloski et al. ..... 4/480
4,278,387 A * 7/1981 Seguela et al. ..... 414/462
4,300,249 A 11/1981 Taylor
4,888,833 A 12/1989 Garcia et al.
4,920,587 A * 5/1990 Kerr ..... 4/480
5,184,653 A * 2/1993 Lacy ..... 141/98
5,373,591 A * 12/1994 Myers ..... 4/560.1
5,373,593 A 12/1994 Decky et al.
5,517,704 A * 5/1996 Dagostino ..... 4/560.1
5,787,518 A 8/1998 Mendelovich et al.
6,418,571 B1 7/2002 Cheng
7,503,081 B2 * 3/2009 Montgomery ..... 4/254

* cited by examiner

*Primary Examiner*—A. Joseph Wujciak, III
*Assistant Examiner*—Todd M. Epps
(74) *Attorney, Agent, or Firm*—David C. Purdue

(57) ABSTRACT

Apparatus for moving a toilet between a position where it is accessible to a person of restricted mobility and a storage position when not in use. The apparatus comprises two cooperating platforms, a first platform which rests on the floor of a room which houses the apparatus and a second platform. The first platform has a guide along an edge, and the second platform has an edge that is slidably received in the guide, and is supported so that it is capable of limited translational movement without rotation relative to the first platform. A physically impaired person can occupy a chair on the first platform, and can slide the second platform relative to the first to move a portable toilet on the second platform between a position in which it can be used and a storage position.

17 Claims, 4 Drawing Sheets

TOILET SYSTEM TO ACCOMMODATE USERS WITH IMPAIRED MOBILITY

BACKGROUND OF THE INVENTION

1. Field of the Invention

The present invention relates generally to a toilet and, specifically, to a toilet that is not plumbed, and is adapted to be moved into and out of a use position with a minimum of effort, especially by persons with reduced or impaired mobility who, nonetheless, have some mobility.

2. Description of the Prior Art

There are numerous toilets that have been specifically designed for people who, because they are recovering from a surgical procedure or an illness or have impaired mobility for some other reason or reasons, would have difficulty getting up and getting to and using a conventionally plumbed toilet in a rest room. During a search of US patents that was made in respect of the present invention, the following patents were noted:

U.S. Pat. No. 4,161,793 discloses a combination stool and toilet device. The device is on spring loaded wheels that retract under the weight of a user so that the device rests firmly and securely on its lower edge. A toilet paper feeding system is connected to one of the wheel mechanisms.

U.S. Pat. No. 4,300,249 discloses a wheel type chair for persons with neurological impairment. The chair includes a built in toilet that is accessed through a trap door in the seat of the chair.

U.S. Pat. No. 4,888,833 discloses a mobile cart for use by handicapped persons and for transporting handicapped persons to a plumbed toilet.

U.S. Pat. No. 4,920,587 discloses a bedside toilet for bed ridden patients. The toilet includes a platform that is convertible to a seat and back again and mechanisms for raising and lowering the platform to a height corresponding with the top of a bed. With the platform in place on the edge of a bed, a bed ridden patient is "rolled" onto the platform which is then manipulated into a seat configuration and used as a toilet.

U.S. Pat. No. 5,184,653 discloses a toilet dolly for moving and holding a plumbed toilet when it is temporarily removed from a closet flange in the floor. The dolly includes a reservoir for receiving any water that might remain in the toilet after it is removed from the closet flange.

U.S. Pat. No. 5,373,593 discloses a handcart for lifting, transporting and installing toilets which facilitates the placement of a toilet over a closet flange and wax ring.

U.S. Pat. No. 5,787,518 discloses a convertible toilet seat for use in combination with a plumbed toilet, especially for children.

U.S. Pat. No. 6,418,571 discloses a toilet chair on wheels. A two piece cushion includes a removable cushion portion and is supported above a container pot that is accessible when the removable cushion portion is removed.

SUMMARY OF THE INVENTION

The present invention is based upon the discovery of a toilet system especially for use by persons with limited mobility who can and will try something new to remain independent so far as toileting themselves is concerned. The invention comprises a platform or platforms for supporting an unplumbed toilet and a chair for relative movement between a first, use position and a second, out of the way position. Preferably, a platform on rollers is used to support a stand alone toilet, such as an RV toilet or a marine toilet, and a stationary platform is used to support a chair. Guide means associated with the platforms provides for relative movement between the stationary chair platform and the rolling toilet platform along a pre-determined path between a first, use position and a second, not in use position. In the use position, the toilet will be immediately in front of the chair and, in the second, not in use position, the toilet will be to the left or to the right of someone seated on the chair on the chair platform who is facing the toilet platform. It is preferred that the chair be secured to and fixed on the stationary platform. It is also preferred that guide means be provided on the stationary platform to cooperate with guide means on the rolling platform so that the guide means serves to maintain the rolling platform adjacent to the stationary platform as the rolling platform moves between the first and second positions. The rolling platform is supported so that someone who is seated on the chair on the stationary platform can manually or, preferably, with his or her feet, move the rolling platform between the first and second positions.

Accordingly, it is an object of the present invention to provide apparatus which someone who is unable to get up or ill suited for getting up and using a conventional plumbed toilet in a rest room, can use to bring a toilet into a first, use position so that he or she may use the toilet and, when done, to move the toilet away to a not in use position.

It is a further object of the invention to provide a means by which infirm people can maintain some independence and take care of toileting themselves while being freed from having to spend all day sitting on a toilet or immediately next to one.

It is yet another object of this invention to provide a portable toilet on a rollable platform for use by someone of limited mobility and to make it easy for that person to move the platform and the toilet into and out of a toilet use position.

It is still another object of the invention to provide a toilet and a chair on a rollable platform for use by someone of limited mobility and to make it easy for that person to move the chair on the platform into and out of a toilet use position.

These and other objects and advantages of the present invention will be fully appreciated by those skilled in the art upon reviewing the disclosures herein.

DETAILED DESCRIPTION OF THE PREFERRED EMBODIMENTS

Figure 1:
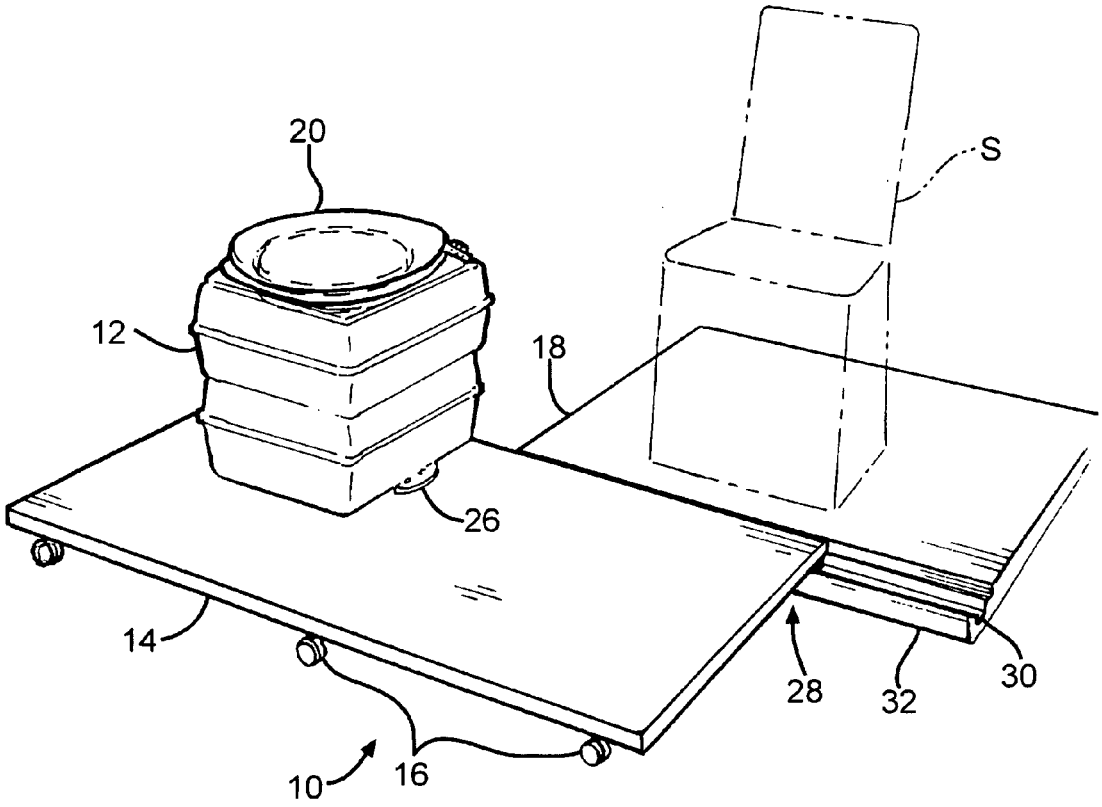
FIG. 1 is a perspective view showing apparatus according to the invention which comprises a portable toilet, a movable platform for the toilet, a platform for a chair or other seat and a guide which limits the movement of the toilet platform relative to the platform for the chair or other seat.
Figure 2:
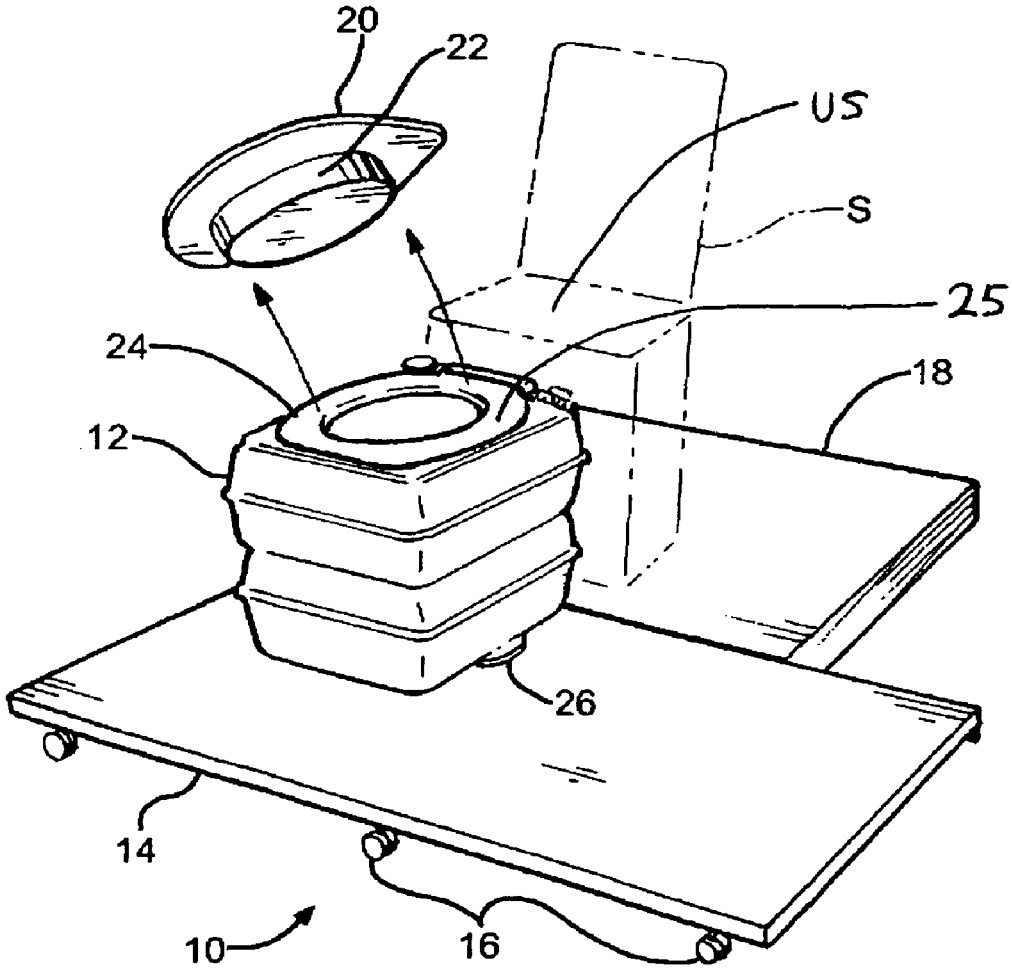
FIG. 2 is a view in perspective of the apparatus of FIG. 1, showing the platform for the toilet in a second position relative to the platform for the chair.

Referring to FIGS. 1 and 2, the apparatus according to the present invention, which is indicated generally at 10, comprises a toilet 12 on a platform 14 which is supported on rollers 16 for limited movement between a first, use, position shown in FIG. 2 and a second, out of the way, position shown in FIG. 1. In the first position, the toilet 12 is positioned in front of a seat S on a platform 18 so that a person occupying the seat S can mount the toilet 12. In FIG. 1, the platform 14 and the toilet 12 are shown in the out of the way position where the toilet is not in the way of a person occupying the seat S.

The toilet 12 is not plumbed, but, preferably is of the type commonly used in camping and marine applications where waste material collects, and is eventually removed. Excellent results have been achieved with a modified version of such a toilet that is commercially available under the designation "Aquamate 875/885" from Thetford, Ann Arbor, Mich. As shown in FIGS. 1 and 2, a lid 20 is not attached to the toilet 12, but has been fitted with a positioning ring 22 which is received in an opening of a seat 24 of the toilet 12. As shown in FIG. 2, the lid 20 is completely separable from the toilet 12. There is a flange 26 on the toilet 12 which is releasably attached to the platform 14, for example by fasteners, not shown.

Figure 3:
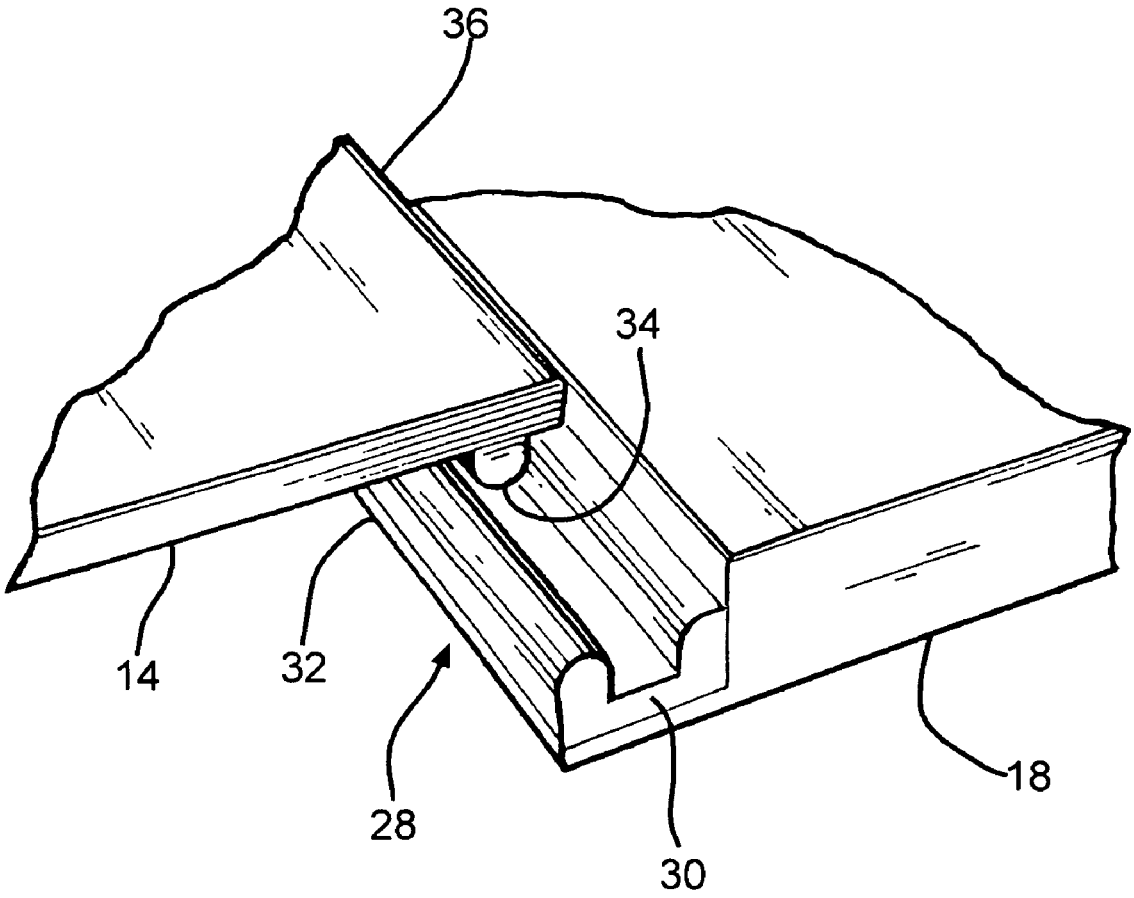
FIG. 3 is a perspective view showing details of the guide.

As shown in FIGS. 1 and 3, guide means 28 on the adjacent edges of the platforms 14 and 18 prevent relative rotational movement and restrict the platform 14 to movement relative to the stationary platform 18 so that the spacing between the adjacent edges of the two remains substantially constant. The guide means 28, in the specific embodiment shown, comprise a member 30 adjacent an edge 32 of the platform 18 which defines an upwardly facing, laterally extending channel and a member 34 which extends downwardly from the platform 14, adjacent an edge 36 thereof, into the channel of the member 30, as shown in FIG. 3.

Figure 4:
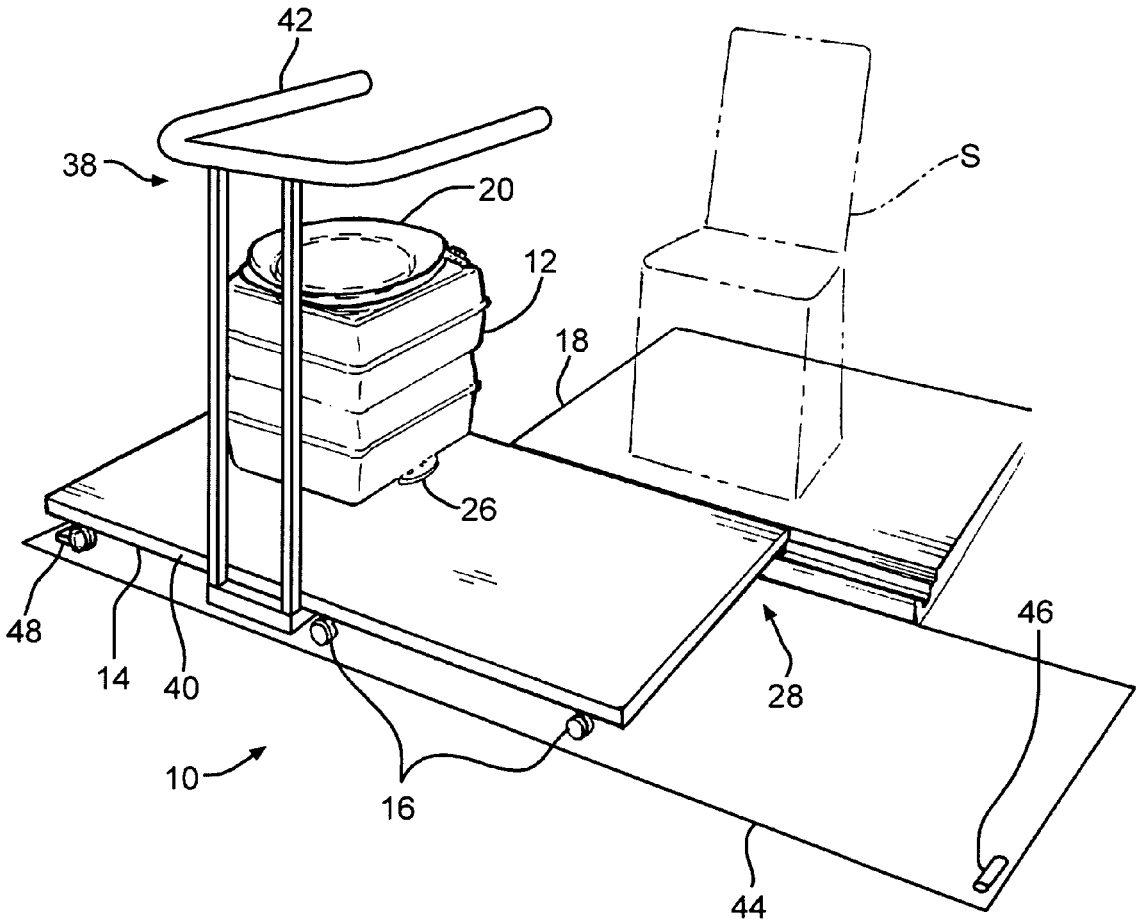
FIG. 4 is a view in perspective of a preferred embodiment of apparatus according to the invention.

Referring now to FIG. 4, apparatus 10 is shown with an added hand rail indicated at 38. The hand rail 38, which is connected under the rollable platform 14, extends upwardly from an edge 40 of the platform 14 and terminates in a handle 42 that extends toward the toilet 12 and offers support and assistance to someone using the apparatus 10. The handle 42 can be grasped and pulled or pushed to move the platform 14 into or out of the out of the way position.

The apparatus 10 is simple to use. It is basically about dignity and it is about providing access to a toilet for someone who isn't very mobile while permitting that person to remove himself or herself physically and mentally from the toilet when it is not needed. The toilet 12 and the toilet platform 14 remain in the out of the way position shown in FIGS. 1 and 4 until an urge is felt by someone seated in the seat S. At that time, while remaining seated, he or she can use his or her feet to act on the platform 14 and/or his or her hands to act on the handle 42, to initiate movement of the platform 14 and the toilet 12 to the use position, causing the platform to roll on the casters 16. When the toilet 12 is next to his or her right leg, he or she can maneuver the leg over or around the toilet while the platform is maneuvered into the use position where the toilet 12 is immediately in front of the seat S. He or she then assumes a position on the toilet 12 and, independently, takes care of his or her business. Toilet paper may conveniently be supported on the handle 42 or on another support (not shown). When he or she is finished using the toilet 12, he or she maneuvers himself or herself back onto the seat S and initiates movement of the platform 14 towards the out of the way position, using his or her feet and/or his or her arms on the platform 14 and/or the handle 42.

Rolling movement of the platform 14 is facilitated, especially in carpeted rooms, by the provision of a subfloor 44 (FIG. 4) which, preferably, extends under both the platform 14 and the stationary platform 18. Stops 46 and 48 may be connected to the subfloor 44 to prevent the platform 14 from moving to the right beyond the use position and to the left beyond the out of the way position. As shown, the platforms 14 and 18 have upper surfaces that are even with each other. This is helpful to one who is using the apparatus 10. It has been determined that the height of the toilet seat 24 relative to the height of the upper surface of the seat S is very important to the successful use of the apparatus 10. Excellent results have been achieved in the case where the upper surface of the seat S was about 2.5 inches (.about. 7 cm) higher than the upper surface of the toilet seat 24. In any case, it is preferred that the upper surface US of the seat S is higher than the upper surface 25 of the toilet seat 24, as shown in FIG. 2. It will certainly be appreciated that the height of the upper surface US of the seat S and/or the height of the upper surface 25 of the toilet seat 24 are easily adjusted, relative to one another, by the use of shims or spacers positioned under the toilet 12 and/or the seat S.

The foregoing detailed description of the invention is set forth to enable one having ordinary skill in this field to carry out the invention and it sets forth the best mode presently known for carrying out the invention. It will be appreciated that the objects and advantages of the invention are not limited to the exact apparatus shown in the drawing Figures and that the apparatus is susceptible to certain changes and modifications without departing from the spirit and scope of the invention.

I claim:

1. An apparatus for supporting and moving a toilet between a position where it is accessible for use to a person of restricted mobility and a remote storage position when not in use, said apparatus comprising a first platform which rests on a floor and is operable to support a chair above the floor, said first platform having a guide extending laterally along an edge, a second platform having a member that cooperates with said guide, said second platform being supported so that it is capable of limited, lateral, translational movement relative to said first platform, and an unplumbed toilet operable to collect waste material for later removal, said toilet being mounted and supported on said second platform, whereby a person of restricted mobility can occupy a chair supported on said first platform so that it is facing said second platform, and can slide said second platform, laterally, relative to said first platform so that the toilet on said second platform is moved between a use position in front of the chair in which it can be mounted and used by the person, and a storage position where it is laterally removed from being in front of the chair and the person, without the person having to walk.

2. The apparatus as claimed in claim 1 wherein said guide is effective to prevent rotation between said first and second platforms.

3. The apparatus as claimed in claim 2 which additionally includes rollers on the underside of said second platform to facilitate its movement.

4. The apparatus claimed in claim 1 which further comprises a subfloor positioned between said second platform and the floor of a room in which the system is being used.

5. The apparatus claimed in claim 1 which further comprises at least one stop operable to prevent relative movement between said first and second platforms beyond the use position, in one lateral direction.

6. The apparatus claimed in claim 1 which further comprises a hand rail connected to said second platform and wherein said hand rail comprises a handle that is supported above said toilet.

7. The apparatus claimed in claim 1 wherein said toilet comprises a seat and an unattached lid with a positioning ring which is operable to engage said seat and locate said lid relative to said seat.

8. The apparatus claimed in claim 1 wherein said platforms each have upper surfaces which are supported at the same height so that they are even.

9. The apparatus claimed in claim 1 which further comprises at least one stop operable to prevent relative movement between said first and second platforms beyond the storage position, in one lateral direction.

10. The apparatus claimed in claim 5 which further comprises a second stop operable to prevent relative movement between said first and second platforms beyond the storage position, in one lateral direction.

11. The apparatus claimed in claim 1 which further comprises a chair supported on said first platform.

12. The apparatus claimed in claim 11 wherein said chair is secured to and supported on said first platform, facing said second platform.

13. The apparatus claimed in claim 11 wherein said platforms each have upper surfaces which are supported at the same height so that they are even.

14. The apparatus claimed in claim 11 wherein said toilet comprises a seat and an unattached lid with a positioning ring which is operable to engage said seat and locate said lid relative to said seat.

15. The apparatus claimed in claim 14 wherein said chair comprises a seat with an upper surface and wherein said toilet seat is lower than said upper surface of said seat of said chair.

16. The apparatus claimed in claim 14 wherein said platforms each have upper surfaces which are supported at the same height so that they are even.

17. The apparatus claimed in claim 15 wherein said platforms each have upper surfaces which are supported at the same height so that they are even.

* * * * *